US007395856B2

(12) United States Patent
Murray

(10) Patent No.: US 7,395,856 B2
(45) Date of Patent: Jul. 8, 2008

(54) DISAPPEARING PLUG

(75) Inventor: Douglas J. Murray, Humble, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/413,899

(22) Filed: Apr. 28, 2006

(65) Prior Publication Data

US 2007/0221373 A1 Sep. 27, 2007

Related U.S. Application Data

(62) Division of application No. 11/388,847, filed on Mar. 24, 2006, now Pat. No. 7,325,617.

(51) Int. Cl.
*E21B 33/12* (2006.01)

(52) U.S. Cl. ..... 166/192

(58) Field of Classification Search ..... 166/382, 166/386, 376, 153, 192
See application file for complete search history.

(56) References Cited

U.S. PATENT DOCUMENTS

| | | | | |
|---|---|---|---|---|
| 3,768,563 | A * | 10/1973 | Blount | 166/291 |
| 5,425,424 | A | 6/1995 | Reinhardt et al. | |
| 5,479,986 | A * | 1/1996 | Gano et al. | 166/292 |
| 5,607,017 | A | 3/1997 | Owens et al. | |
| 5,660,232 | A | 8/1997 | Reinhardt | |
| 5,765,641 | A | 6/1998 | Shy et al. | |
| 6,026,903 | A | 2/2000 | Shy et al. | |
| 6,076,600 | A | 6/2000 | Vick, Jr. et al. | |
| 6,220,350 | B1 | 4/2001 | Brothers et al. | |
| 6,712,153 | B2 | 3/2004 | Turley et al. | |
| 6,769,491 | B2 | 8/2004 | Zimmerman et al. | |
| 6,896,063 | B2 | 5/2005 | Chang et al. | |
| 6,907,936 | B2 | 6/2005 | Fehr et al. | |
| 2004/0238173 | A1 | 12/2004 | Bissonnette et al. | |
| 2005/0205264 | A1 | 9/2005 | Starr et al. | |
| 2005/0205265 | A1 | 9/2005 | Todd et al. | |
| 2005/0205266 | A1 | 9/2005 | Todd et al. | |

* cited by examiner

*Primary Examiner*—David J. Bagnell
*Assistant Examiner*—Robert E Fuller
(74) *Attorney, Agent, or Firm*—Steve Rosenblatt

(57) ABSTRACT

A system allows for sequential treatment of sections of a zone. Access to each portion can be with a sliding sleeve that has a specific internal profile. Pump down plugs can be used that have a specific profile that will make a plug latch to a specific sleeve. Pressure on the plug when latched allows a sequential opening of sleeves while zones already affected that are below are isolated. The pump down plugs have a passage that is initially obstructed by a material that eventually disappears under anticipated well conditions. As a result, when all portions of a zone are handled a flow path is reestablished through the various latched plugs. The plugs can also be blown clear of a sliding sleeve after operating it and can feature a key that subsequently prevents rotation of the plug on its axis in the event is later needs milling out.

2 Claims, 9 Drawing Sheets

DISAPPEARING PLUG

PRIORITY CLAIM

This application is a divisional application claiming priority from U.S. patent application Ser. No. 11/388,847, filed on Mar. 24, 2006 now U.S. Pat No. 7,325,617.

FIELD OF THE INVENTION

The field of the invention is completion techniques and more particularly those involving sequential procedures in a zone which need periodic obstruction of the flow bore to conduct the operation and need the flow bore cleared thereafter for production. More specifically the invention focuses on plugs that temporarily block a flow path and then at least in part disappear to allow flow to resume.

BACKGROUND OF THE INVENTION

Some completion methods require sequential isolation of adjacent zones in an interval to perform treatments such as fracing. Typically the zones are isolated with packers and in between them there are sliding sleeves that can be selectively opened to provide access. Typically, this assembly is run in to position, and then a ball or plug is pumped down to the bottom which closes off the flow path through the bottom end of the liner. Pressure is applied and the packers are set, creating multiple isolated zones. The tubular string is pressurized and the lowermost sliding sleeve is opened. After the lowermost zone is treated a ball is dropped on a lowermost seat to close off the zone just treated and the pressure is built up on this first dropped ball to open the next sliding sleeve up. After that treatment an even bigger ball lands on an even bigger seat to close off the second zone just treated. The process is repeated until all zones are treated using a progression of bigger and bigger seats as the treatment moves toward the surface. At the end, the balls on all the seats are either floated to the surface when the flow commences from the treated formation or the assembly of all the seats and the balls that are respectively on them are milled out so as not to impede subsequent production from the treated zone. This technique is shown in U.S. Pat. No. 6,907,936. The problem with it is that different sized seats are required at specific locations to make the isolation system work and in the end there are some rather small passages through the smallest of the seats even if the balls are floated out that then requires a discrete step of milling out the seat and ball near all but one sliding sleeve.

Techniques have been developed to temporarily block wellbores using dissolving or other wise disappearing plugs. Such devices are illustrated in U.S. Pat. Nos. 6,220,350; 6,712,153 and 6,896,063. Some packers are built to be disposable involving the use of degradable polymers as illustrated in US Publication No. 2005/0205264; 2005/0205265 and 2005/0205266. Some assemblies involve landing collars that can be changed from a go to a no go orientation with a shifting tool that also doubles as a tool to operate sliding sleeves. This is illustrated in US Publication No. 2004/0238173. Yet other designs that create selective access into a formation by using perforating charges that blow out plugs in casing or pressure actuated pistons with internal rupture discs are illustrated in U.S. Pat. Nos. 5,660,232 and 5,425,424. U.S. Pat. No. 6,769,491 illustrate a typical anchor assembly for a downhole tool.

The present invention seeks to streamline certain downhole operations by matching profiles on plugs to those on sliding sleeves or nipple profiles. This allows a specific plug to be located at a certain location and bypass other potential landing locations. The flow path can be identical in size for the duration of different portions can be addressed in a particular sequence. Apart from that, the plugs, after having served their purpose, reopen the flow path for further operations. These and other benefits of the present invention will be more readily understood by those skilled in the art from a review of the description of the preferred embodiment that appears below, as well as the drawings and the claims, which define the full scope of the invention.

SUMMARY OF THE INVENTION

A system allows for sequential treatment of sections of a zone. Access to each portion can be with a sliding sleeve that has a specific internal profile. Pump down plugs can be used that have a specific profile that will make a plug latch to a specific sleeve. Pressure on the plug when latched allows a sequential opening of sleeves while zones already affected that are below are isolated. The pump down plugs have a passage that is initially obstructed by a material that eventually disappears under anticipated well conditions. As a result, when all portions of a zone are handled a flow path is reestablished through the various latched plugs. The plugs can also be blown clear of a sliding sleeve after operating it and can feature a key that subsequently prevents rotation of the plug on its axis in the event it later needs milling out.

DETAILED DESCRIPTION OF THE DRAWINGS

Figure 12A:
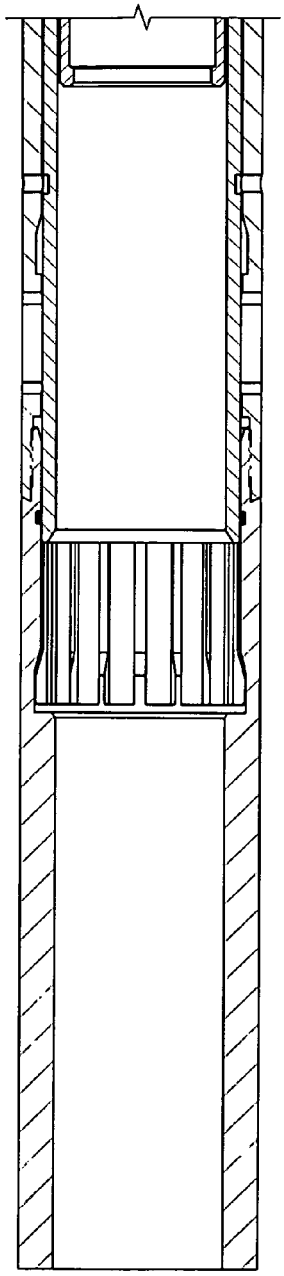
Figure 13A:
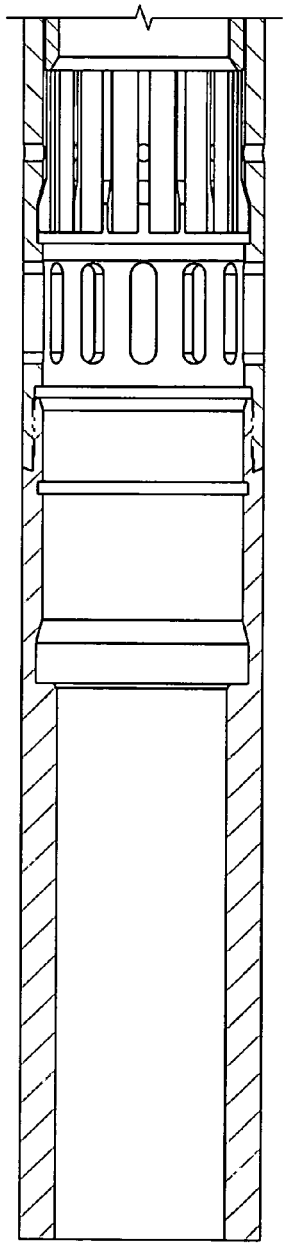
Figure 14A:
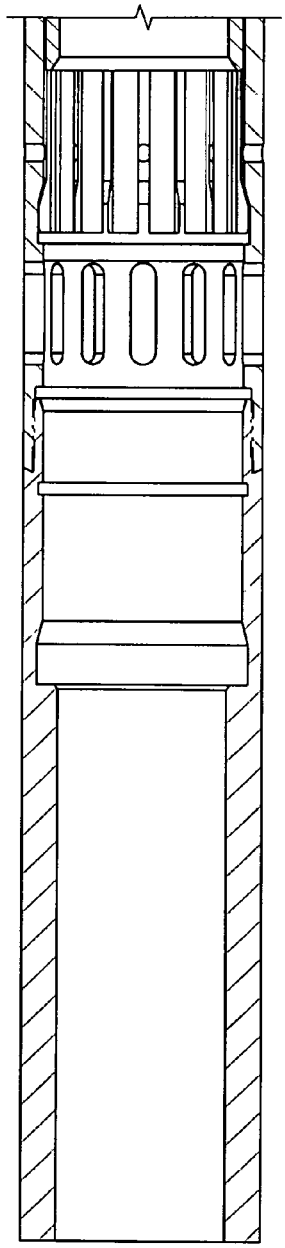
Figure 12B:
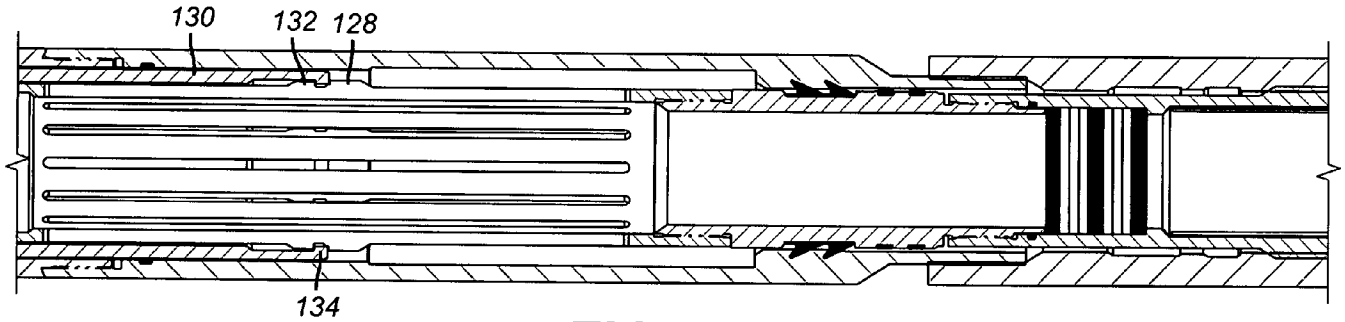
Figure 13B:
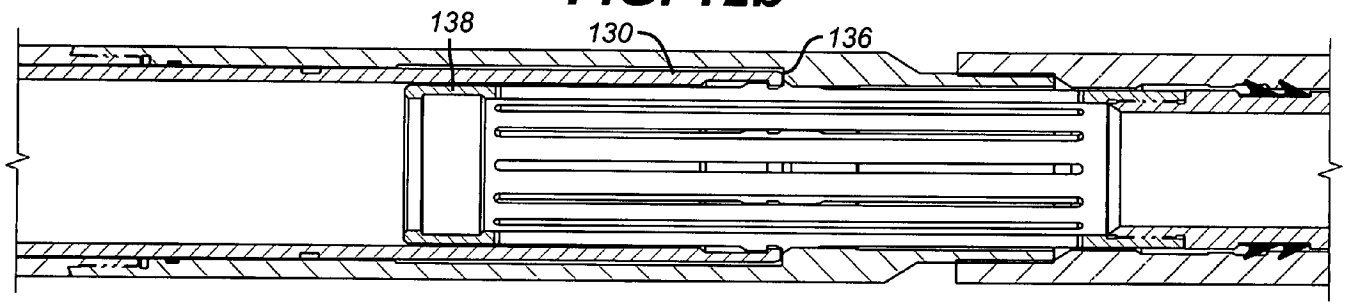
Figure 14B:
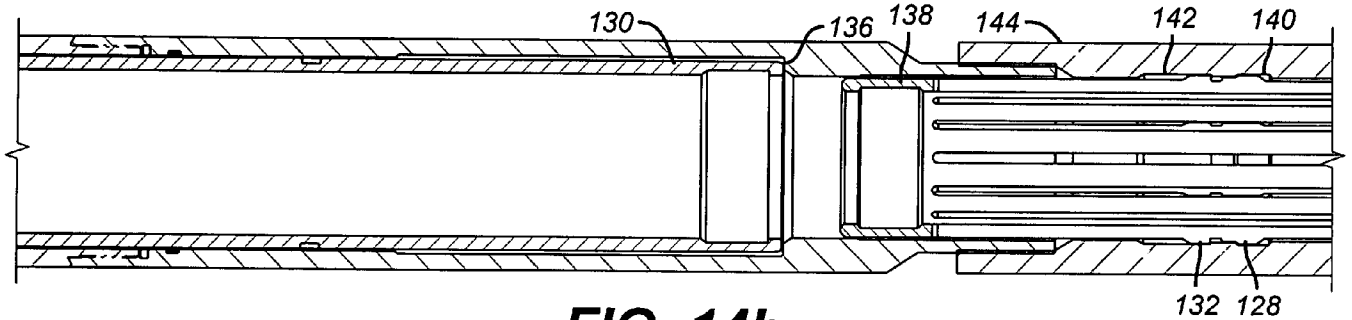
Figure 12C:
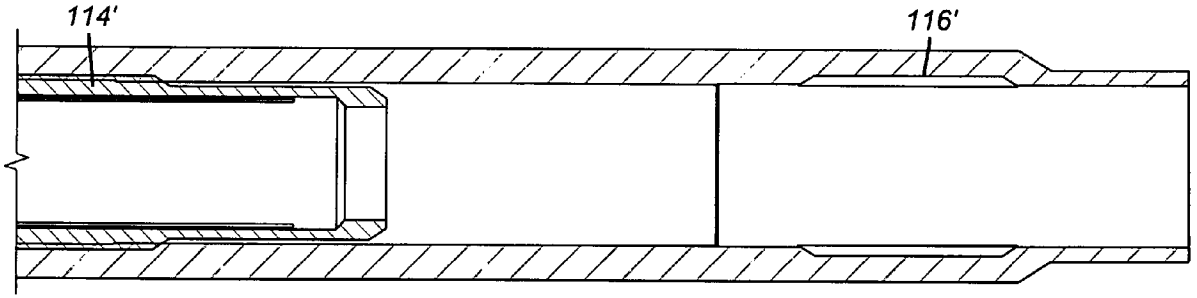
Figure 13C:
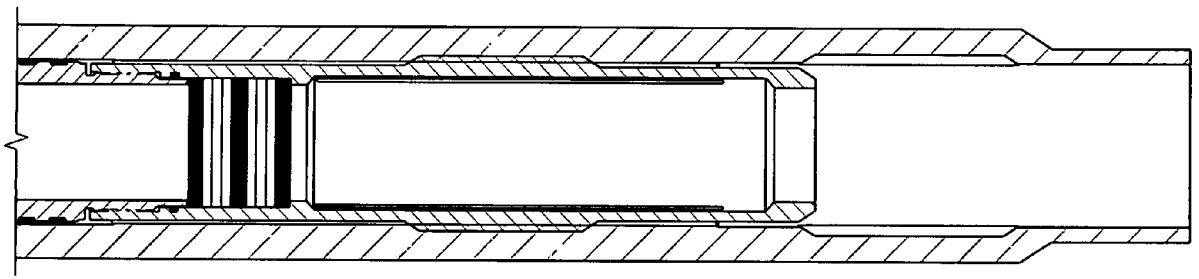
Figure 14C:
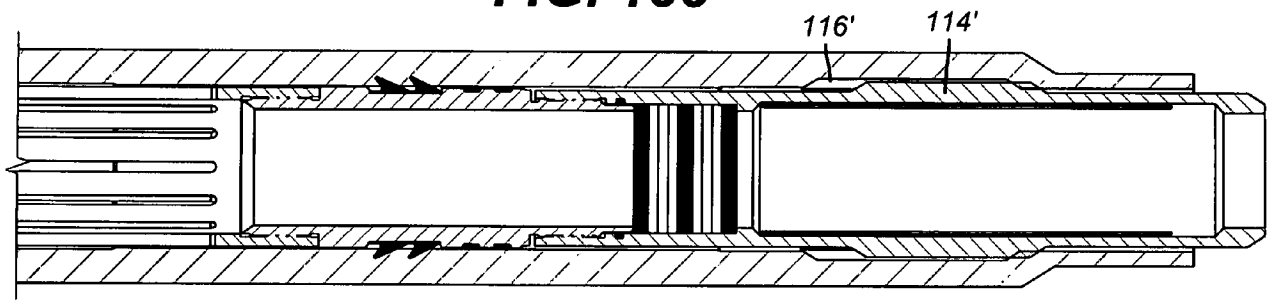
Figure 15:
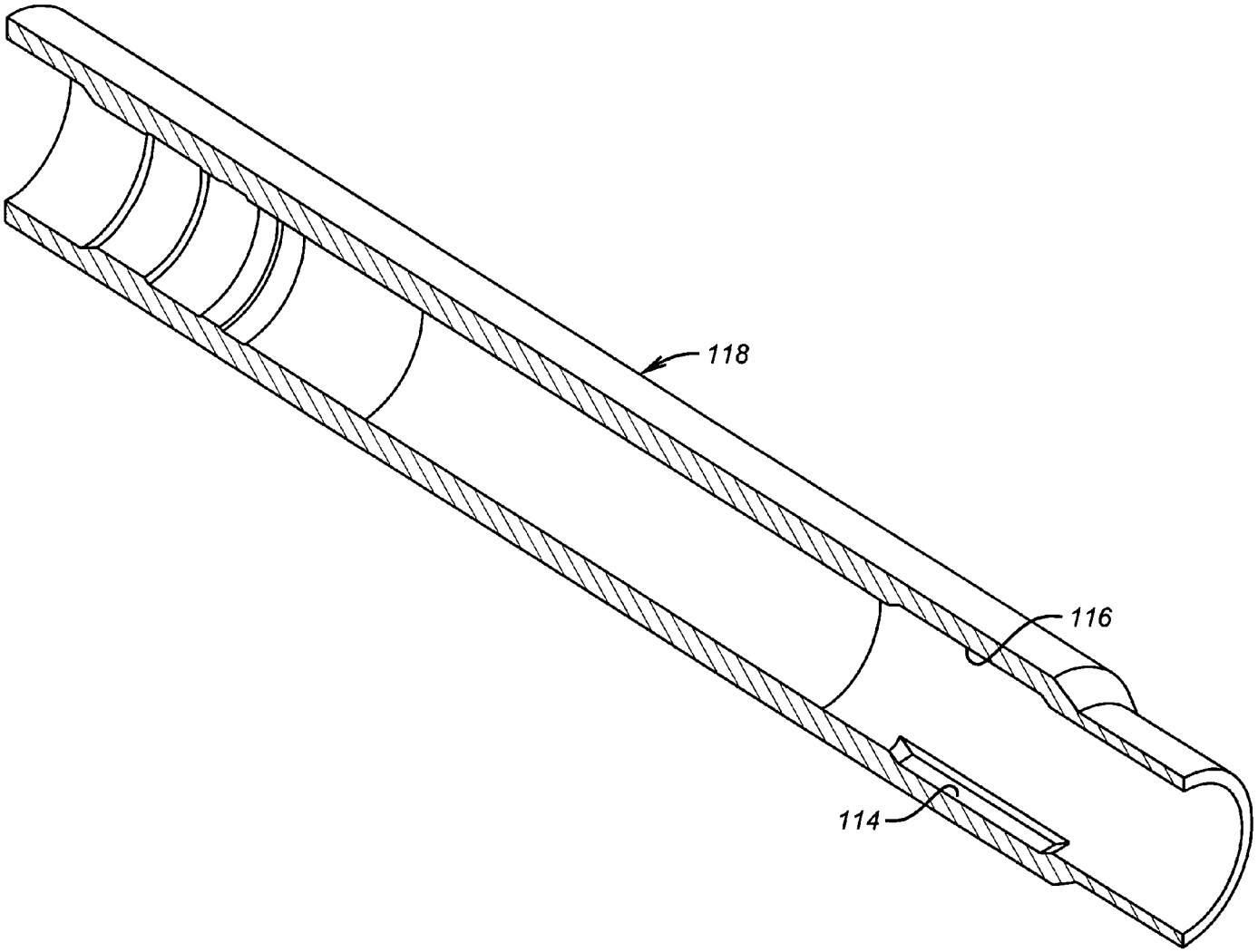
Figure 16:
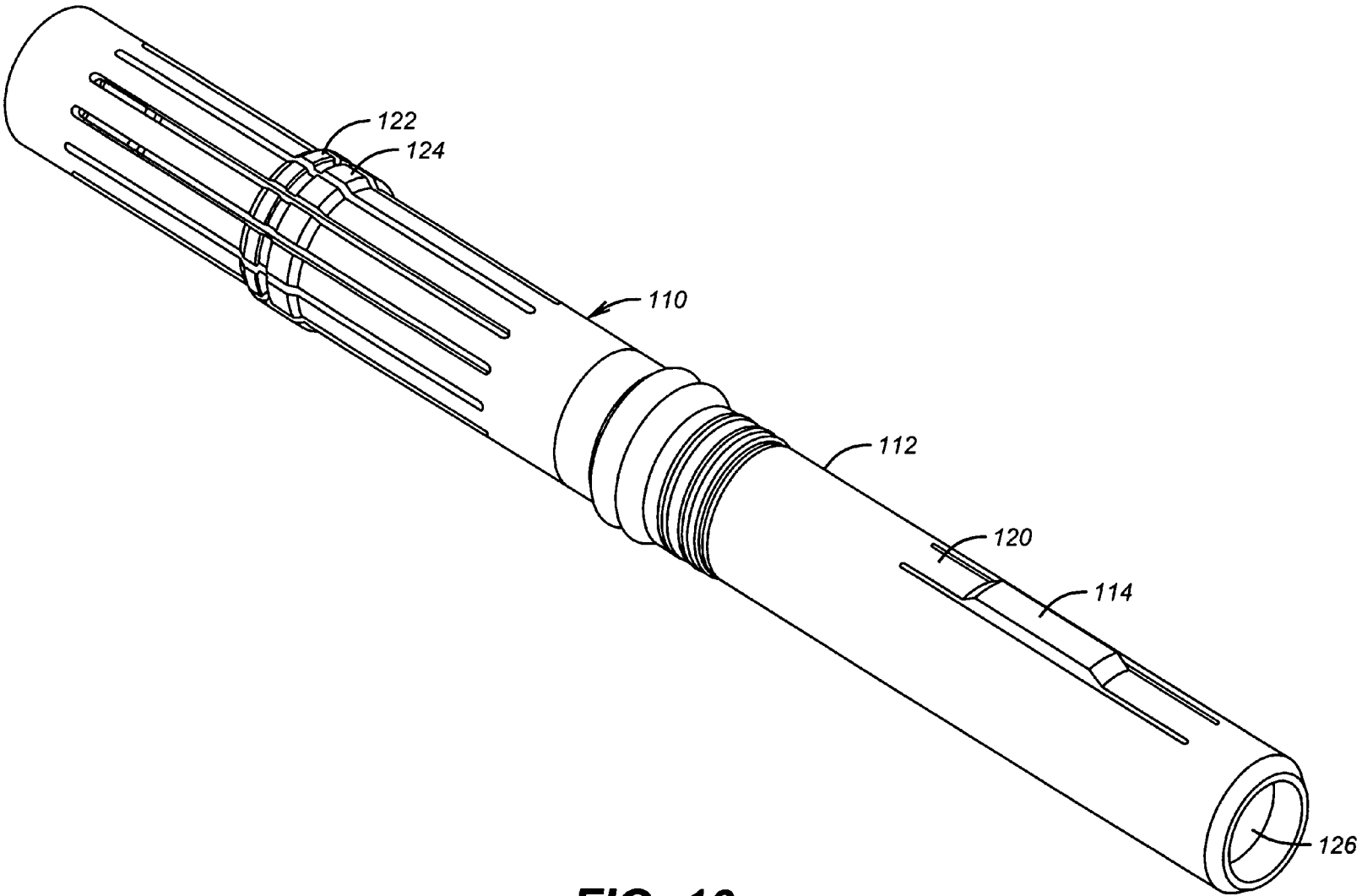

FIGS. 12*a-c* are a section view of an alternative pump down plug design showing the plug landed in the sliding sleeve;

FIGS. 13*a-c* are the view of FIGS. 12*a-c* with the sliding sleeve shifted;

FIGS. 14*a-c* are the view of FIGS. 13*a-c* with the plug released from the sliding sleeve and captured on a landing collar;

FIG. 15 is a part section perspective view showing the sliding sleeve and a groove that holds the pump down plug against turning if the plug is milled out;

FIG. 16 is the pump down plug in perspective showing the lug that resists turning if the plug is milled out.

DETAILED DESCRIPTION OF THE PREFERRED EMBODIMENT

Figure 1:
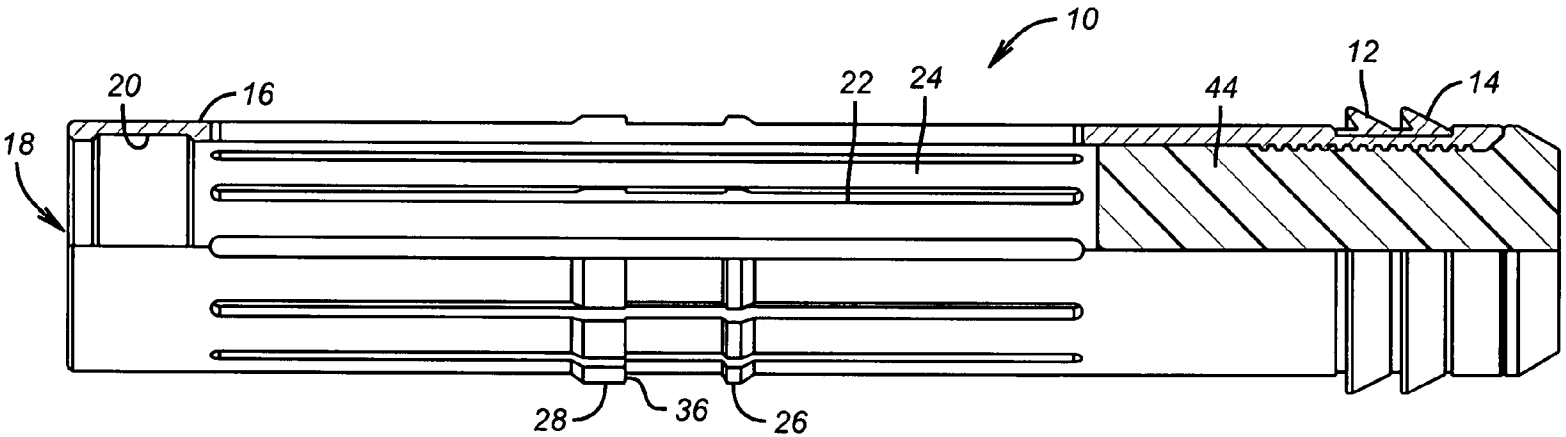
FIG. 1 is a section view of a pump down plug before it is pumped downhole.
Figure 3:
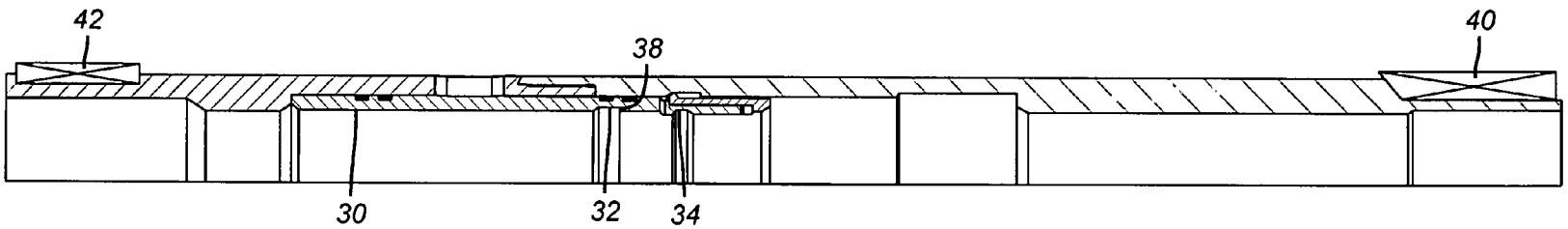
FIG. 3 is a section view of a typical sliding sleeve in the closed position.

FIG. 1 shows a typical pump down plug 10 that has wiper seals 12 and 14 to make contact with the surrounding tubular so that it can be pumped down. Although cup seals are shown, other types and quantities of seals can be used. The plug 10 has a tubular body 16 with a through passage 18. Near end 20 is a fishing neck 22 to be used if the plug 10 is to be fished out for any reason. A series of longitudinal grooves 22 define flexible collet fingers 24 that are attached at opposed ends to body 16. Cantilevered fingers can be alternatively used or any other structure that can maintain a cylindrical shape with sufficient strength and still allow flexing. The flexing feature allows the protrusions 26 and 28 to move radially as the plug 10 is pumped downhole. While the preferred plug 10 has seals 12 and 14 the invention envisions a plug 10 that simply is dropped making the use of seals 12 and 14 optional. Looking at FIG. 3, there is a sliding sleeve 30 that has depressions 32 and 34 that are designed to match the shape of protrusions 26 and 28 on the plug 10. As the plug 10 approaches the sliding sleeve 30 the fingers 24 flex to let the protrusions 26 and 28 jump up on the sleeve 30 and then spring out into depressions 32 and 34 as radial surface 36 on projection 28 registers with radial surface 38 on depression 32.

Those skilled in the art will appreciate that while 2 protrusions 26 and 28 are shown on the plug 10 to match similarly shaped depressions on the sliding sleeve 30 there are many different ways to execute the inventive concept. The concept is to create a unique match between a given plug 10 and a given downhole location which happens to be a sliding sleeve such as 30. For example, when treating a long zone there will be a plurality of sliding sleeves such as 30 that have packers such as 40 and 42 to isolate a surrounding annulus (not shown). The idea is to progressively isolate parts of a zone working uphole so that the next sliding sleeve between a pair of packers can be opened for treating the formation between those two packers while the portions below already treated are isolated.

Figure 2:
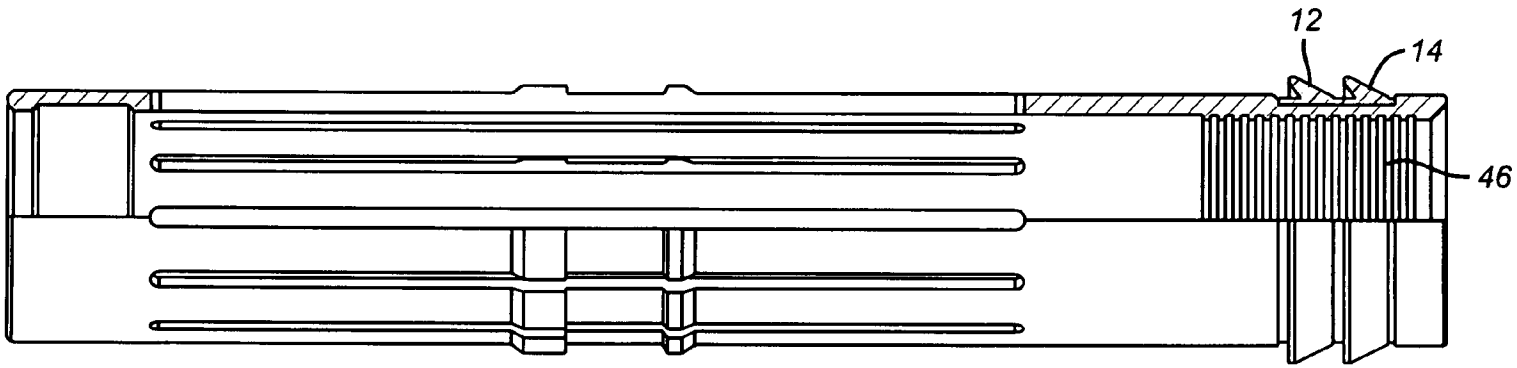
FIG. 2 is the plug of FIG. 1 with the passage through the plug open after the nose plug has disappeared.

To better understand how this happens reference is again made to FIG. 1 where the passage 18 is shown to be blocked by what will generically be referred to as a disappearing material 44. In this application, the phrase disappearing material is intended to encompass a wide variety of materials used alone or in combination that can retain structural integrity during the pump down procedure but over time when subjected to well conditions whether existing or artificially created will lose that integrity and no longer block the passage 18, as shown in FIG. 2. Threads 46 are visible in FIG. 2 after the disappearing material 44 has gone away. They are used to initially retain the material 44 in position as shown in FIG. 1. The preferred material 44 is a biopolymer that responds to well temperature. Generally when a plug is pumped down from the surface, the fluids used and the flow keeps the material 44 in a plug 10 strong enough to withstand that applied pumping pressures. After a particular portion of a zone is treated through an open sleeve such as 30, another plug lands in the next sleeve. That cuts off all the lower plugs from flow and allows them to come to equilibrium with well temperatures. Over time the material 44 in the lower plugs disappears opening a path 18 through the lower plugs as plugs land above them in another sliding sleeve.

Figure 4:
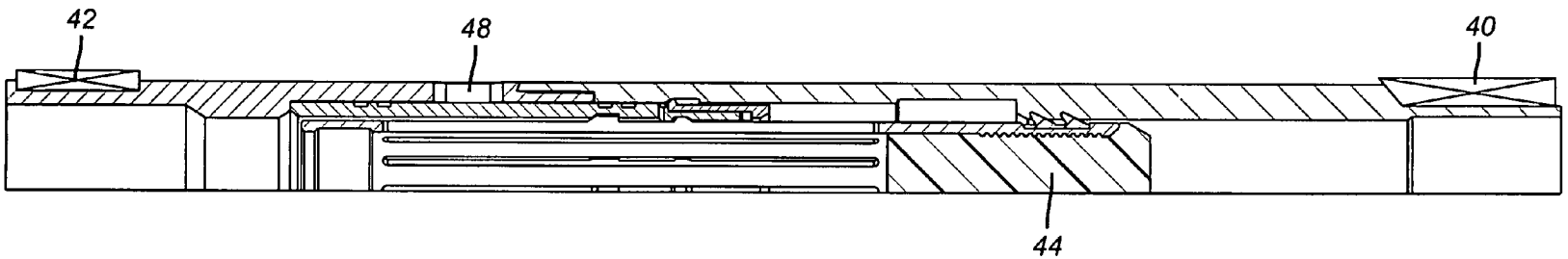
FIG. 4 is a section view of the pump down plug landed on the sliding sleeve.
Figure 5:
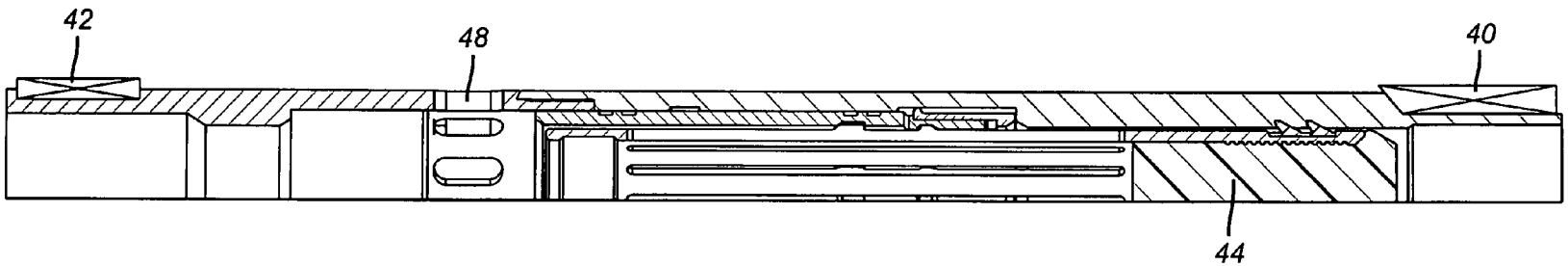
FIG. 5 is the view of FIG. 4 with pressure applied and the sleeve shifted to an open position.

FIGS. 4 and 5 show how a plug 10 with projections 26 and 28 registered with depressions 34 and 32 respectively can be used to shift sleeve 30 from the closed position with ports 48 closed in FIG. 4 and where they are open in FIG. 5. By design, the material 44 continues to block passage 18 with ports 48 open so that a frac job for example can be accomplished through ports 48 with a zone isolated between two external packers 40 and 42.

One aspect of the invention is that a given plug has a profile on the fingers 24 that registers with a specific sliding sleeve profile in the embodiment of FIGS. 1-5. The concept is related to a key in a lock cylinder. Combinations of protrusions and depressions can be used with either one being on the plug or the sleeve and the mating profile on the other member. The registration can be determined by having a protrusion and mating depression have similar longitudinal lengths to make them register. There can be more than one pair of protrusions and matching depressions and their spacing from each other can be unique to a given sliding sleeve and a plug that will match.

If fracing is to be done for example, using sliding sleeves A, B and C where A is furthest from the surface, the procedure would be to run the assembly into position and set packers between A,B and C and another above C. All sleeves would be run in closed. To frac the zone adjacent sliding sleeve A the string is simply pressurized to open sleeve A to treat the furthest zone from the surface. Sleeve A can be a pressure to open design. When that zone is done a plug is pumped down into sleeve B and that effectively isolates the zone just treated through sliding sleeve A. This plug has a pattern on its fingers to register only with sleeve B. Pressure is built up again and sleeve B opens and treatment of the zone through open sleeve B takes place. When that treatment is done, another plug specially configured to register only with sleeve C is pumped down. Pressure is again built up and the zone is treated through open sliding sleeve C. While that is going on the plug in sleeve B is isolated by virtue of the plug above it and it starts to warm to well temperature and the material 44 in that plug disappears. When pumping is stopped against the plug in sliding sleeve C, it too warms up and the material 44 in it disappears. What are then left are the open passages in the two plugs 18 with all sleeves open and the need to go in and drill out is not there. The treated formation can simply be produced. Should it be desired, the plugs could be fished out using necks 20.

While a procedure with 3 sleeves A, B and C has been described those skilled in the art will understand any number of sleeves that have external isolation devices can be used. The only difference among the sleeves is the profile on them is unique to each and the plugs pumped down have matching profiles to properly land in the sleeves in the desired sequence. In the preferred bottom up sequence each successive plug isolates an already treated zone while the material 44 in that now isolated plug just disappears. What's left is a fully treated interval and a fully open passage to the entire treated interval with no need to drill or mill ball seats as in the past. In the preferred embodiment the sleeves that span the zone can all have similar internal diameters and the unique patterns that register between a plug and a sleeve will ensure that similarly dimensioned plugs wind up at the right sleeve. After it is all done each plug now with its material 44 disappeared presents a consistent flow path 18 to the entire treated interval.

In an optional variation, instead of using the material 44 an easily milled disc can be provided. While this way will require subsequent intervention after all the plugs are in place, the milling should go quickly if only the discs themselves are milled out and not the plugs that retain them. Thereafter, with the passage in each plug open, production can flow through them all. Any remnants from milling can be brought to the surface with this production.

Figure 6:
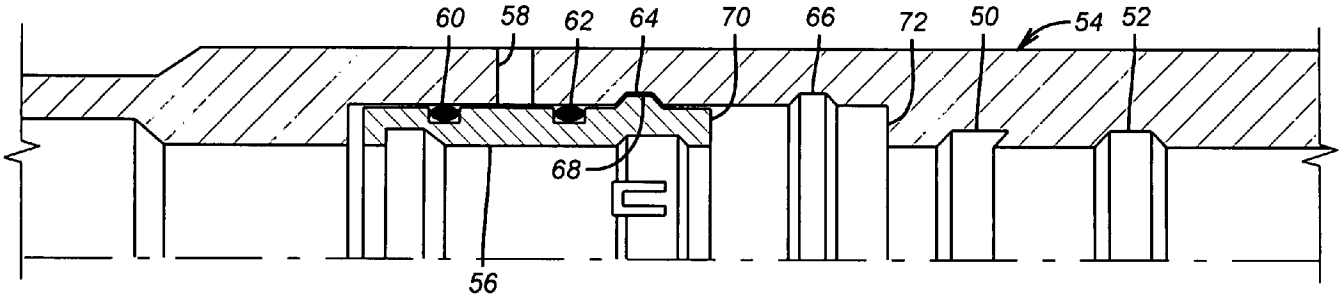
FIG. 6 is a section view of an alternative embodiment showing the sliding sleeve closed and the profile to receive the pump down plug.
Figure 7:
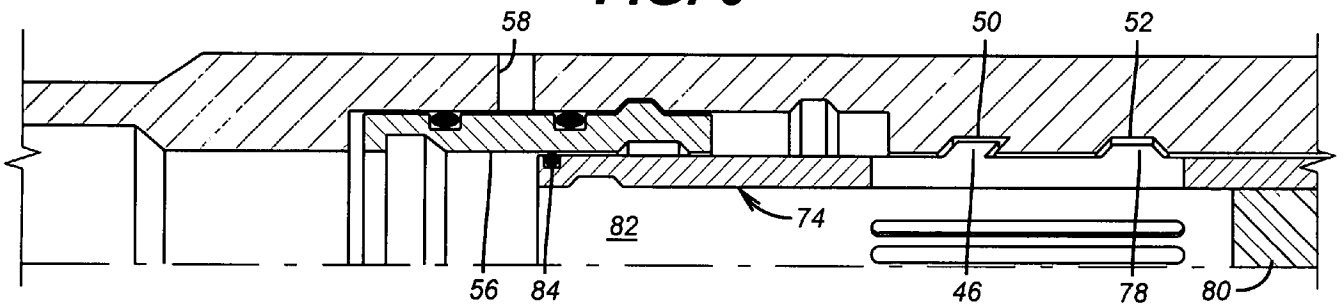
FIG. 7 is the view of FIG. 6 with the pump down plug landed creating a piston around the sliding sleeve.
Figure 8:
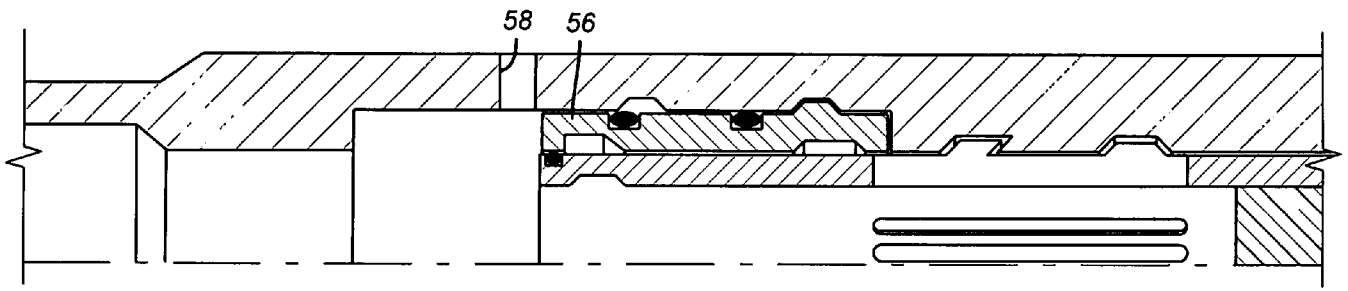
FIG. 8 is the view of FIG. 7 with pressure applied that results in shifting the sliding sleeve.

While the embodiment in FIGS. 1-5 registered with a given sleeve, the embodiment in FIGS. 6-8 registers with grooves 50 and 52 in the housing 54. The sliding sleeve 56 initially covers ports 58 as seals 60 and 62 straddle the ports 58. Projection 68 initially registers with depression 64 to hold the sleeve 56 in the FIG. 6 closed position. Eventually when lower end 70 of sleeve 56 hits shoulder 72, the projection 68 will register with depression 66 as shown in FIG. 8. FIG. 7 shows a plug 74 that has projections 76 and 78 to match depressions 50 and 52 fully registered. Since material 80 is intact and closes passage 82, and seal 84 contacts sleeve 56 any applied pressure on plug 74 now moves sleeve 56 because sleeve 56 is now turned into a piston. The final position of sleeve 56 is shown in FIG. 8 with ports 58 open.

In this embodiment a given plug has a unique profile or pattern than is matched in the housing adjacent to a sleeve as opposed to literally on the sleeve in the case of FIGS. 1-5 to be sure a plug lands adjacent a desired sleeve to turn it into a piston so that pressure above it can force it to shift to open the associated ports. Again the plug uses a disappearing material 80 that goes away after it is isolated by another plug latched above it. As in the case of the procedure described above for FIGS. 1-5 the FIGS. 6-8 procedure is similar with the main difference being that in FIGS. 1-5 the plug literally moves the sleeve and in FIGS. 6-8 the latched plug allows pressure to force the sleeve open in a piston effect. In other respects the procedure is similar.

Figure 9:
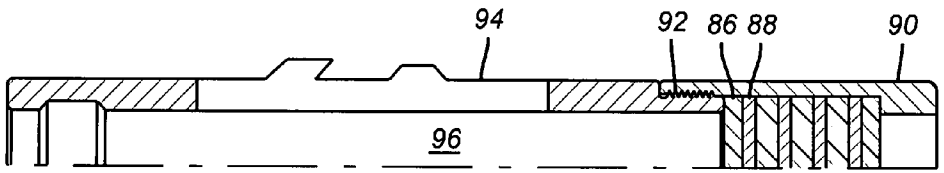
FIG. 9 is a section of a pump down plug showing the disappearing portion in the nose.
Figure 10:
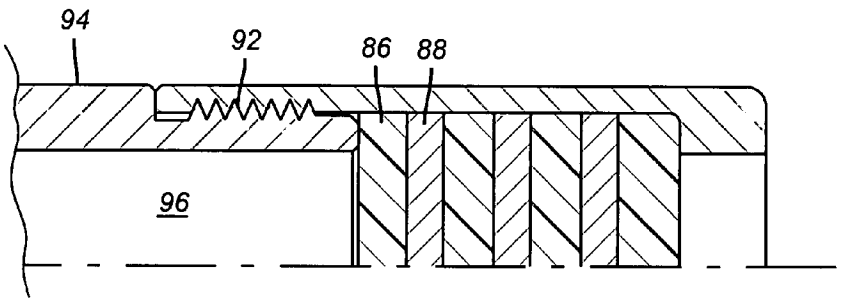
FIG. 10 is a closer view of FIG. 9 showing how the disappearing portion is attached to the pump down plug.

FIGS. 9 and 10 illustrate an embodiment for the disappearing material plug 44 or 80 illustrated in use in FIGS. 1-8. Since the material needs some structural strength to withstand differential pressure during pumping procedures like a frac job, the design features alternating layers of a biopolymer 86 alternating with water soluble metal discs 88. In the assembly, the discs 88 are all internal. The biopolymer 86 has a relatively slow dissolving rate coupled with poor creep resistance. The discs 88 are fast dissolving but add strength and creep resistance. A retaining sleeve 90 engages thread 92 on housing 94 to compress the assembly within passage 96 for run in. Longitudinal compression creates a better peripheral seal in housing 94.

Figure 11:
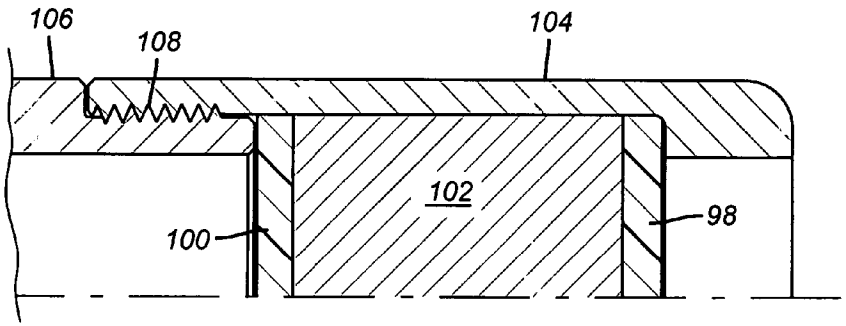
FIG. 11 is a section of an alternative design of the disappearing component.

FIG. 11 represents another construction for such a plug as an alternative to the one illustrated in FIGS. 9 and 10. Here the end components 98 and 100 are preferably a biopolymer with a relatively slow dissolving rate and poor creep resistance. Sandwiched in between is a granular substance such as, for example, sand, frac proppant or glass micro spheres 102. When a directional load is placed on either end component 98 or 100 the applied stress is transferred to the layer 102 and due to shifting of the granular material the load is shifted outward against ring 104 that is secured to the housing 106 at thread 108 before it can migrate to the opposite end component. This helps to retain the sealing integrity of the assembly. As before in FIGS. 9 and 10, the ring 104 is used to initially longitudinally squeeze the assembly for better sealing. After exposure to well temperatures for a long enough period, the end components dissolve and production can be used to deliver the granular substance to the surface.

While two specific embodiments have been described as a unique way to block a passage in a plug that disappears, those skilled in the art will appreciate that independent of the specific execution of the disappearing member the invention encompasses the use of other assemblies that disappear by a variety of mechanisms apart from dissolving when used in the contexts that here described in the application and covered in the claims.

Referring now to FIG. 16 another optional feature of a plug 110 is illustrated. Here there is a leading section 112 that has one or more projections 114 that are designed to enter a matching depression 116 seen in section in FIG. 15. Although not shown, those skilled in the art will appreciate that alignment ramps to interact between a plug 110 and the surrounding housing 118 to get the projection 114 to properly align with a depression 116 can be used. However, since the projection is on a flexible finger 120 and the purpose of the registration of parts is to prevent rotation if the plug is to be milled out for any reason, alignment device will not be necessary because some rotation induced from milling will result in registration of 114 with 116 as long as they are supported at the same elevation from the registration of projections 122 and 124 above.

FIGS. 12-14 show the plug illustrated in FIG. 16 (where the disappearing material is not shown in passage 126) used to shift a sleeve and then get off the sleeve and latch to a body just below the sleeve. In FIG. 12*b* projection 128 is just below the bottom of sleeve 130 while projection 132 has engaged a radial surface 134 on the sleeve 130. FIG. 12*c* shows the offset at this time between the torque resisting projection 114' and the receiving recess 116'. In FIG. 12 the sleeve 130 has not been shifted. Moving on to FIG. 13*b* the sleeve 130 is now shifted to travel stop 136 with plug 138 still engaged at radial surface 134 of sleeve 130. In FIG. 14*b* the fully shifted sleeve 130 is no longer engaged by the pumped plug 138. Instead, projections 128 and 132 are now registered with recesses 140 and 142 while torque resisting projection 114' is registered with recess 116'. Those skilled in the art will realize that the torque resistance feature is optional and that it can be used regardless of whether the pumped plug 138 remains connected to the sleeve 130 after shifting it or, as shown in FIGS. 12-14 leaves the sleeve 130 to register with housing 144.

It is worthy of mention again that all types of ways to obtain a unique registering location between a given plug and a given sleeve or a given downhole location are part of the invention. While projections and depressions have been used as an example with either member capable of having one or the other, other combinations that result in registrations of selected pump down plugs at different locations are within the scope of the invention. The sleeves or landing locations can be all the same diameter but what makes them unique is the ability to register with a specific plug that has a profile that registers with it.

Yet another aspect of the present invention is to use progressively larger seats as described in U.S. Pat. No. 6,907,936 except to make the obstructing members of a disappearing material so that when all zones are treated, all the seats are reopened. While this embodiment has the disadvantage that without milling there are well obstructions that vary in size, it does retain an advantage over the method in the aforementioned patent in that production can begin without milling out balls on seats.

In another technique, a plurality of nipple profiles that are unique can be placed in a casing string. A pump down plug that supports a perforating gun can be delivered to register with a particular nipple profile whereupon registering at the proper location pressure above the now supported plug can fire the gun. In that manner an interval can be perforated in a specific order and intervals already perforated can be isolated as other portions of the interval are perforated.

In another embodiment the sliding sleeves that have explosive charges to open access to the formation as described in U.S. Pat. No. 5,660,232 can be selectively operated with the pump down plugs described above that register with a discrete sleeve to open access to the formation in a desired order. The technique can also be grafted to the sliding sleeves used in combination with telescoping pistons as described in U.S.

Pat. No. 5,425,424 to selectively shift them in a desired order using the techniques described above.

The above description is illustrative of the preferred embodiment and many modifications may be made by those skilled in the art without departing from the invention whose scope is to be determined from the literal and equivalent scope of the claims below.

I claim:

1. A plug assembly for downhole use, comprising:

a flexible body having a longitudinal axis and opposed ends and an outer surface defining a chamber therein, said chamber comprising a granular material that is responsive to a longitudinal compressive load applied to at least one of said ends, said granular material substantially redirecting said longitudinal compressive force toward said outer surface and away from an end opposite the end where said force was applied; and at least one of said ends dissolve at least in part upon exposure to downhole conditions for a predetermined time;

a housing with a passage to retain said body in said passage, further comprising an adjustment member to apply a longitudinal compressive load on said body urging said outer surface into greater sealing contact with said passage.

2. The assembly of claim 1, wherein:

said granular material comprises at least one of sand, frac proppant and glass micro spheres.

* * * * *